US012084958B2

(12) United States Patent
Alruwaili et al.

(10) Patent No.: US 12,084,958 B2
(45) Date of Patent: Sep. 10, 2024

(54) SYSTEMS AND METHODS FOR DETERMINING ROCK STRENGTHS

(71) Applicant: SAUDI ARABIAN OIL COMPANY, Dhahran (SA)

(72) Inventors: Khalid Mohammed Alruwaili, Dammam (SA); Murtadha J. Altammar, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/150,035

(22) Filed: Jan. 4, 2023

(65) Prior Publication Data

US 2024/0218778 A1 Jul. 4, 2024

(51) Int. Cl.

| | |
|---|---|
| ***E21B 43/119*** | (2006.01) |
| ***E21B 43/117*** | (2006.01) |
| ***E21B 43/26*** | (2006.01) |
| ***E21B 44/00*** | (2006.01) |
| ***E21B 47/12*** | (2012.01) |
| ***E21B 47/26*** | (2012.01) |

(52) U.S. Cl.

CPC ..... *E21B 44/00* (2013.01); *E21B 43/117* (2013.01); *E21B 43/26* (2013.01); *E21B 47/12* (2013.01); *E21B 47/26* (2020.05)

(58) Field of Classification Search

CPC ..... E21B 43/116; E21B 43/117; E21B 43/119

See application file for complete search history.

(56) References Cited

U.S. PATENT DOCUMENTS

| | | | | |
|---|---|---|---|---|
| 6,679,323 | B2 | 1/2004 | Vargervik et al. | |
| 8,096,355 | B2 * | 1/2012 | McDaniel | G01S 13/88 166/250.1 |
| 8,126,646 | B2 | 2/2012 | Grove et al. | |
| 9,328,606 | B2 * | 5/2016 | D'Angelo | E21B 47/107 |
| 9,376,902 | B2 | 6/2016 | Prioul et al. | |
| 9,725,993 | B1 * | 8/2017 | Yang | E21B 43/119 |
| 10,352,153 | B2 * | 7/2019 | Bell | E21B 47/10 |
| 10,364,387 | B2 * | 7/2019 | Collier | C09K 8/80 |

(Continued)

FOREIGN PATENT DOCUMENTS

| | | |
|---|---|---|
| CN | 101476488 A | 7/2009 |
| EP | 2457082 A1 | 5/2012 |

OTHER PUBLICATIONS

Kahraman, S., Aloglu, A.S., Aydin, B. and Saygin, E., 2017. The needle penetration test for predicting coal strength. Journal of the Southern African Institute of Mining and Metallurgy, 117(6), pp. 587-591.

(Continued)

*Primary Examiner* — Kenneth L Thompson

(74) *Attorney, Agent, or Firm* — Vorys, Sater, Seymour and Pease LLP

(57) ABSTRACT

In some examples, a system can include a computer-readable medium storing computer-executable instructions and one or more processors communicatively coupled to a computer-readable medium storing computer-executable instructions, which, when executed by the one or more processors cause the one or processors to receive data of a fracking stage, determine a penetration gradient of the fracking stage based on the data, and classify the fracking stage based on the penetration gradient.

15 Claims, 6 Drawing Sheets

(56) References Cited

U.S. PATENT DOCUMENTS

| | | | | |
|---|---|---|---|---|
| 11,326,422 | B2 * | 5/2022 | Burky | E21B 43/119 |
| 11,499,401 | B2 * | 11/2022 | Eitschberger | E21B 43/117 |
| 11,585,646 | B2 * | 2/2023 | Haggerty | F42B 35/00 |
| 2007/0044969 | A1 * | 3/2007 | Grove | E21B 43/119 166/55 |
| 2016/0348479 | A1 | 12/2016 | Oehring et al. | |
| 2021/0215039 | A1 | 7/2021 | Scharf et al. | |
| 2021/0270115 | A1 | 9/2021 | Pfutzner et al. | |

OTHER PUBLICATIONS

Zhang, Hui, Deng, Qiao, Li, Jun, Hou, Xuejun, and Hao Wang. "A New Method of Estimating Penetration Depth With Different Perforation Parameters." Paper presented at the ISRM International Symposium—10th Asian Rock Mechanics Symposium, Singapore, Oct. 2018.

Harvey, J., Grove, B. and Zhan, L., 2012, February. Stressed rock penetration depth correlation. In SPE International Symposium and Exhibition on Formation Damage Control. OnePetro.

Huang, H., 2012, March. Effects of high pressure strength of rock material on penetration by shaped charge jet. In AIP Conference Proceedings (vol. 1426, No. 1, pp. 1153-1156). American Institute of Physics.

* cited by examiner

SYSTEMS AND METHODS FOR DETERMINING ROCK STRENGTHS

FIELD OF THE DISCLOSURE

This disclosure relates generally to determining rock strengths, and more particularly, to a systems and methods for digitally determining rock strengths in situ using penetration gradients.

BACKGROUND OF THE DISCLOSURE

In the oil and gas industry, field development can depend upon a fracturing plan. Proper rock characterization enables design of the fracturing plan. Rock characterization is performed by determining properties of a formation. For fracturing, rock fracability is a characterization that indicates the tendency of a rock to fail in response to force (e.g., loading). Rock fracability is dependent upon rock strength. Rock strength is a measure of force required to rupture a rock and is dependent on multiple properties such as density, porosity, grain size and shape, and integrity.

In general, different rocks differ in their strength; denser rocks such as dolomites and limestones are stronger than less dense rocks such as shales or sandstones. Strength is generally characterized by greater surface area contact between grains, but the behavior of solid materials under force is complex; therefore, to develop the fracturing plan, rock strength is measured in labs using rock samples (e.g., core samples) to determine resistance to deformation under force. For instance, a scratch test measures a resistance of the rock sample to indentation due to a constant compression load, while triaxial load frame testing measures a resistance of the rock sample to shearing due to a constant compression load from a pressurized fluid. Indirect methods may also be used to estimate rock strength. For instance, mechanical earth models (MEMs) that illustrate relationships between different properties and rock fracability may be generated from logging data such as seismic data, mud logs, well logs, image data, in situ temperature, stress, and pressure measurements, or a combination thereof.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a system can include a computer-readable medium storing computer-executable instructions and one or more processors communicatively coupled to a computer-readable medium storing computer-executable instructions, which, when executed by the one or more processors cause the one or processors to receive data of a fracking stage, determine a penetration gradient of the fracking stage based on the data, and classify the fracking stage based on the penetration gradient.

In another embodiment consistent with the present disclosure, a method for determining a strength of a formation material can include receiving, using one or more sensors, data of a fracking stage, determining a penetration gradient of the fracking stage based on the data, and classifying the fracking stage based on the penetration gradient.

Any combinations of the various embodiments and implementations disclosed herein can be used in a further embodiment, consistent with the disclosure. These and other aspects and features are better appreciated according to the following description of certain embodiments presented herein in accordance with the disclosure and the accompanying drawings and claims.

DETAILED DESCRIPTION

Figure 1:
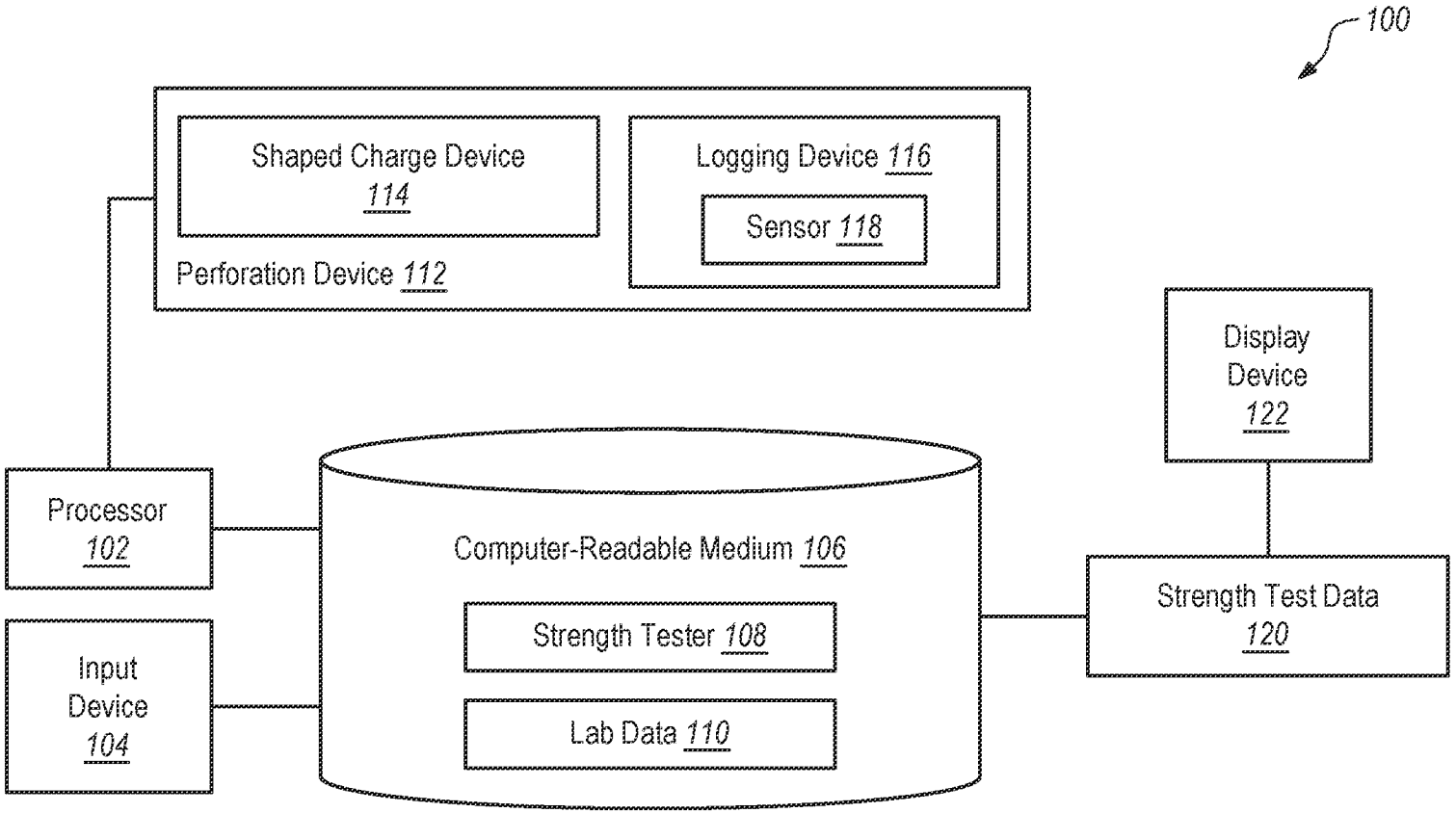
FIG. 1 is an example of a system for determining a penetration gradient of a formation material of a fracking stage, in accordance with certain embodiments.

Embodiments of the present disclosure will now be described in detail with reference to the accompanying Figures. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to determining rock strengths, and more particularly, to systems and methods for digitally determining rock strengths in situ using penetration gradients. As described above, rock strength can be measured in labs using rock samples from core samples or estimated using indirect methods, such as MEMs. Lab data, as used herein, collectively refers to lab measurements and indirect methods of estimating rock strength. However, the lab data does not include in situ measurements of a formation in response to fracking. Examples are described herein in which a system is used for determining rock strengths in situ using one or more penetration gradients. The penetration gradients can be used to validate the lab data and improve rock strength estimates derived from the lab data. By validating lab data and improving rock strength estimates, the penetration gradients may be used to improve a fracking plan for each fracking stage. Additionally, the system can be used in other industries outside of oil and gas, for example, in the mining industry, the quarry industry, the hydrological industry, or like industries in which drilling or quarrying of subterranean formations can performed. Thus, the system as described herein can be used in any environment or industry to improve rock strength determinations.

The system can include a perforation device having a logging device and a shaped charge device. The shaped charge device is to create a cluster of one or more perforation tunnels in the formation material of a fracking stage. The logging device is to detect a depth of each perforation tunnel of the one or more perforation tunnels. A strength tester (e.g., implemented as computer-executable instructions) of the system is to receive the one or more depths of the fracking stage and determine a corrected shaped charge force per cluster of the fracking stage. The strength tester is to determine a penetration gradient of each cluster of the fracking stage based on the one or more depths and the corrected shaped charge force. The strength tester uses Equation 1, for example, to determine the penetration gradient:

$$\text{penetration gradiant}\left(\frac{N}{\text{in}}\right) = \sum_{i=1}^{n} \frac{\text{corrected shaped charged force per cluster}(N)}{\text{penetration depth of perforation(in)}}, \quad \text{(Equation 1)}$$

where n is a number of perforation tunnels of a cluster, and where a unit of the penetration gradient is Newtons per inch (N/in). The strength tester divides the corrected shaped charge force of the cluster by a depth of each perforation tunnel of the one or more perforation tunnels of the cluster, respectively, to determine a penetration gradient for each perforation tunnel. The strength tester sums the penetration gradients of each perforation tunnel to determine the penetration gradient of the cluster. In response to a fracking stage including multiple clusters, the strength tester sums the penetration gradients of each cluster of the fracking stage to determine a penetration gradient of the fracking stage.

The strength tester may output a plot of the penetration gradient of the fracking stage versus lab data. The lab data may be uniaxial compressive strength (UCS) measurements, for example. The UCS measurements may represent mechanical, geological, or petrophysical data for a type of rock, for example. In some embodiments, the strength tester determines, using the plot, a risk profile for the cluster of the one or more perforation tunnels in a formation of the fracking stage and outputs a classification of the fracking stage based on the risk profile. Based on the classification, the shaped charge device may create one or more additional tunnels in the formation of the fracking stage. By enabling in situ determination of rock strength of a formation material of a fracking stage, the system enables improving a determination of a number of perforation clusters within the fracking stage. Improving the determination of the number of perforation clusters within the fracking stage improves resource extraction from the fracking stage.

FIG. 1 is an example of a system 100 for determining a penetration gradient of a formation material of a fracking stage, in accordance with certain embodiments. The system 100 includes a perforation device 112 and a strength tester 108. The perforation device 112 includes a logging device 116 and a shaped charge device 114. The shaped charge device 114 is operable to create one or more perforation tunnels in one or more clusters of a formation material of a fracking stage, as described with respect to FIG. 2, for example. In a non-limiting example, a processor 102 of the system 100 causes the shaped charge device 114 to perforate a casing of the fracking stage to create a cluster of one or more perforation tunnels within a formation material of the fracking stage. The logging device 116 is operable to detect a depth of perforation tunnels of the one or more perforation tunnels. In a non-limiting example, the logging device 116 includes a sensor 118 for detecting the depth. The sensor 118 may include at least one of a fiber optic sensor, a sonic sensor, a high-resolution acoustic imaging sensor, an electromagnetic sensor, a Radio Detection and Ranging (RADAR) sensor, a Light Detection and Ranging (LiDAR) sensor, or the like, for example. The sensor 118 may detect one or more of acoustic measurements, electromagnetic (EM) field measurements, imaging measurements, or the like, for example. In a non-limiting example, the processor 102 receives the data detected by the sensor 118 and stores the data to a computer-readable medium 106.

The data of the logging device 116 (e.g., the data detected by the sensor 118) is input to the strength tester 108 of the system 100. In a non-limiting example, the data is stored to a computer-readable medium 106 of the system 100 by the processor 102. The strength tester 108 is a computer application including computer-executable instructions stored to the computer-readable medium 106, for example. Execution of the computer-executable instructions by the processor 102 causes the processor 102 to determine a penetration gradient of the fracking stage based on the data. In a non-limiting example, the processor 102 retrieves the data from the computer-readable medium 106 to determine the penetration gradient of the fracking stage. In another non-limiting example, the processor 102 receives the sensor data from the logging device 116 to determine the penetration gradient of the fracking stage. The strength tester 108 uses Equation 1, as described herein, to determine the penetration gradient of the fracking stage. For example, the processor 102 determines a corrected shaped charge force of the cluster. The corrected shaped charge force of the cluster corrects for the energy loss (e.g., force loss) due to casing. In a non-limiting example, the processor 102 determines the corrected shaped charge force of the cluster by looking up a value stored to the computer-readable medium 106 as the lab data 110. The value may be a result of a yard test, for example. The processor 102 determines the penetration gradient of the cluster based on the corrected shaped charge force and the depth of each perforation tunnel of the one or more perforation tunnels. In a non-limiting example, the cluster includes multiple perforation tunnels, and the processor 102 determines a penetration gradient of each perforation tunnel of the multiple perforation tunnels by dividing the corrected shaped charge force by a depth for each perforation tunnel. The processor 102 sums the penetration gradients of each perforation tunnel of the multiple perforation tunnels to determine the penetration gradient of the cluster. In another non-limiting example, the fracking stage includes multiple clusters, and the processor 102 determines the penetration gradient of the fracking stage by summing the penetration gradient of each cluster of the multiple clusters.

The strength tester 108 classifies the fracking stage based on the penetration gradient of the fracking stage. In a non-limiting example, the strength tester 108 outputs a plot of each penetration gradient associated with the fracking stage versus lab data 110 associated with the fracking stage (e.g., the plot 300 of penetration gradients of multiple fracking stages, as described herein with respect to FIG. 3).

The lab data 110 may include one or more sets of geological data, mechanical data, petrophysical data, or a combination thereof determined by lab measurements or indirect methods. The lab data 110 may include at least one of cohesion measurements, friction angle measurements, brittleness measurements, UCS measurements, or the like, for example. In a non-limiting example, a user of the system 100 may use an input device 104 to enter the lab data 110, which may then be stored to the computer-readable medium 106. Based on a comparison of the one or more penetration gradients of the fracking stage and the lab data 110, the strength tester 108 determines a classification for the fracking stage. In a non-limiting example, the classification indicates a risk associated with the fracking stage. The risk may indicate a risk of linear deformation, an inability to initiate a fracture, a likelihood of non-uniform fluid distribution across the fracking stage, or other like fracking-related complication. For example, the classification may indicate a high, medium, or low risk.

In a non-limiting example, the processor 102 causes the shaped charge device 114 to create one or more additional perforation tunnels in the fracking stage based on the classification of the fracking stage. For example, in response to the risk, the strength tester 108 may determine a number of clusters to create in the fracking stage to improve resource extraction. The strength tester 108 may compare the number of clusters to a number of clusters of a perforation plan for the fracking stage and increase or decrease the number of clusters of the perforation plan for the fracking stage to be equivalent to the number of clusters determined in response to the risk.

The strength tester 108 may output the penetration gradient of the fracking stage, the classification of the fracking stage, the risk associated with the fracking stage, the number of clusters determined in response to the risk, the perforation plan, an updated perforation plan, or a combination thereof, as strength test data 120. In a non-limiting example, the processor 102 causes a display device 122 to display the strength test data 120, as described with respect to FIG. 3 or 4. The processor 102 may store the strength test data 120 to the computer-readable medium 106 in some examples.

Using the strength tester 108 for determining a penetration gradient of a fracking stage in situ eliminates an uncertainty caused by reliance upon lab data 110 alone, minimizes human errors resulting from measurements of the lab data 110, and improves recovery of resources of the fracking stage. Furthermore, because the strength tester 108 stores strength test data in digital form (e.g., in the computer-readable medium 106), this can improve recovery of resources by increasing a pool of available strength test data for formations of different materials.

Figure 2:
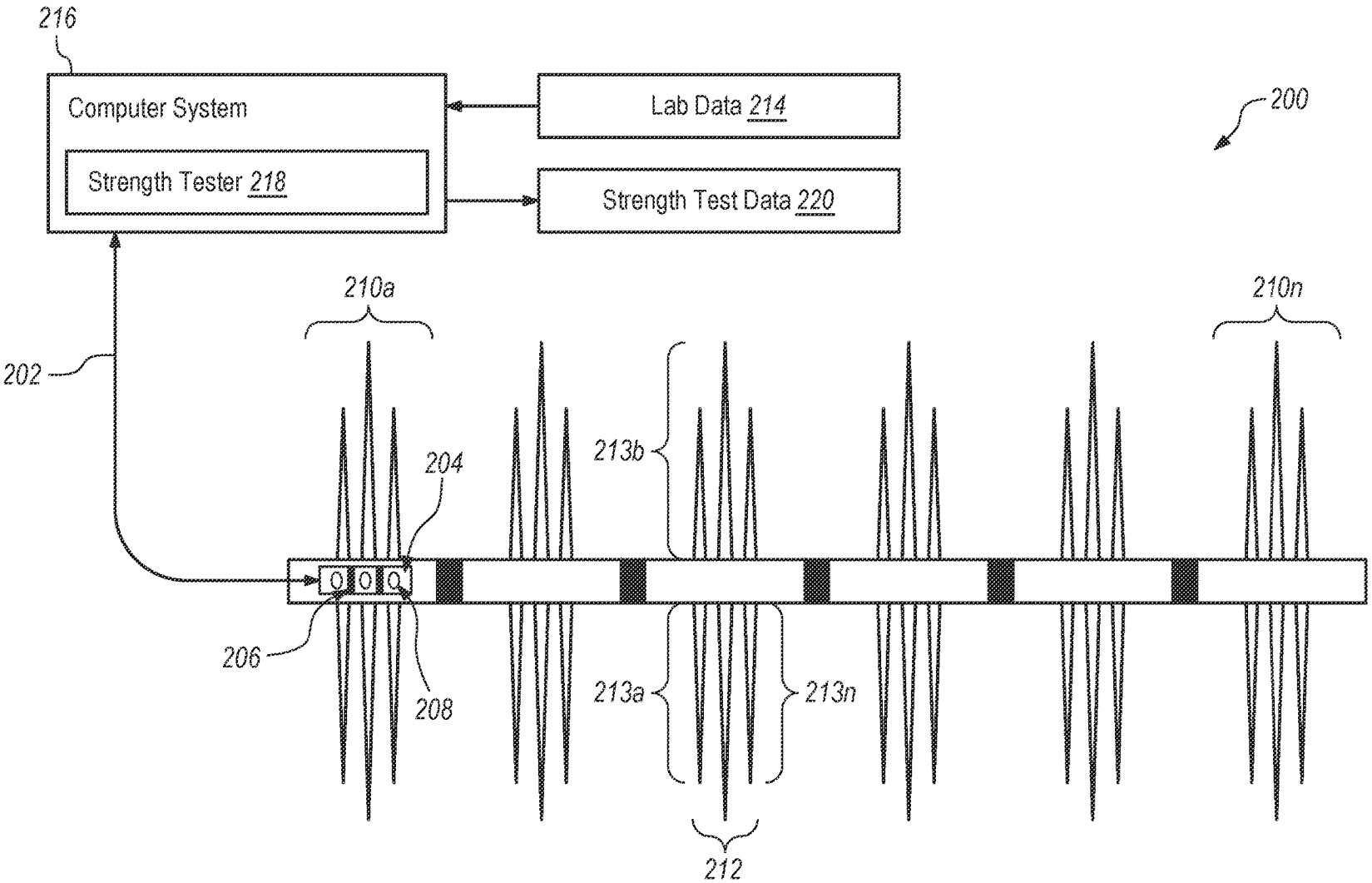
FIG. 2 is an example of a system for determining a penetration gradient of a formation material of multiple fracking stages, in accordance with certain embodiments.
Figure 6:
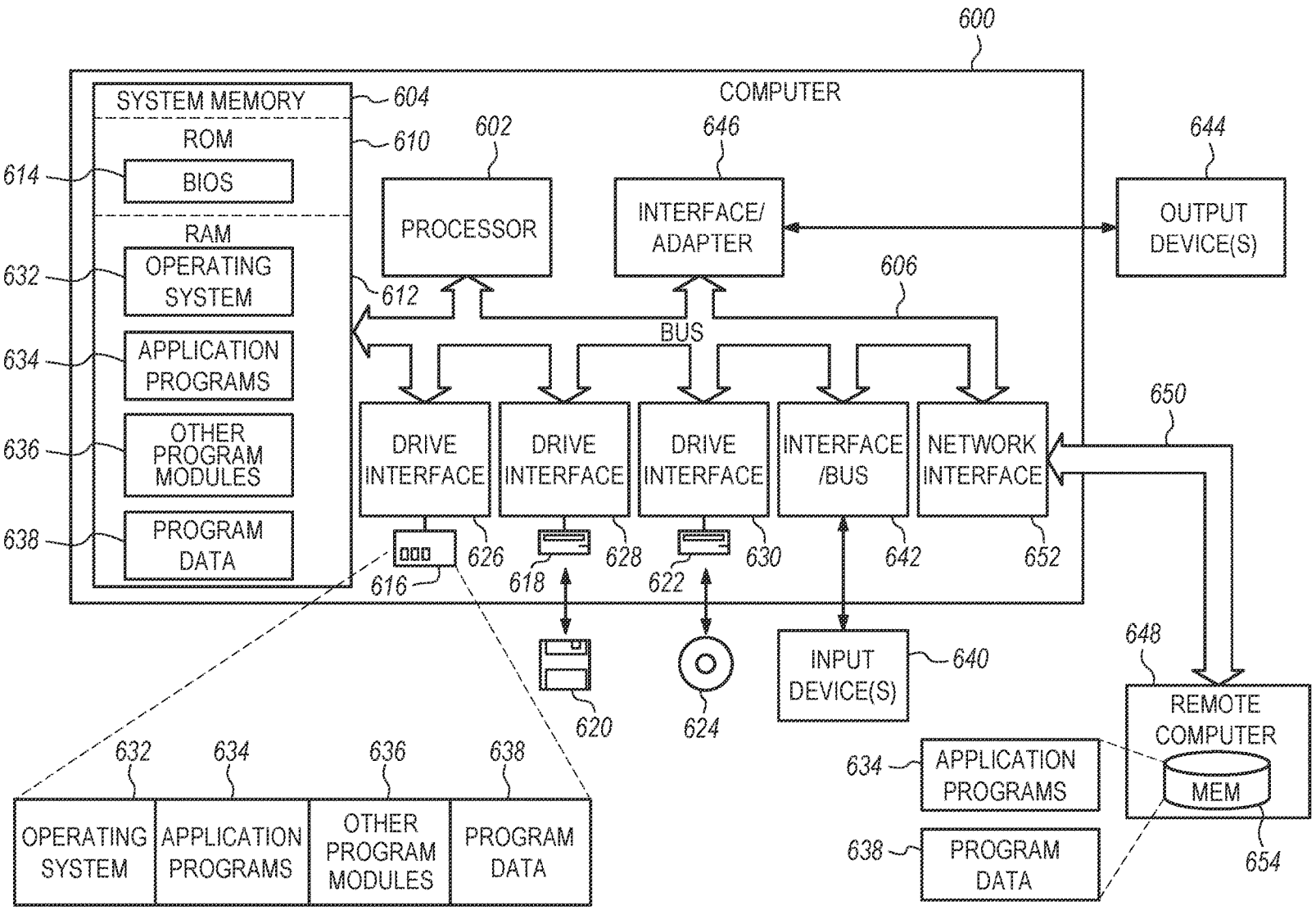
FIG. 6 is a block diagram of a computer system that can be employed to determine penetration gradients, in accordance with certain embodiments, in accordance with certain embodiments.

In a non-limiting example, a computer system, as described with respect to FIG. 2 or 6, includes one or more of the processor 102, the input device 104, the computer-readable medium 106, and the display device 122. While the examples described herein show a processor within a computer system separate from the perforation device, in other non-limiting examples, the perforation device 112 or another tool of the tool string includes one or more of the processor 102, and the computer-readable medium 106. The input device 104 may be a device used for inputting the strength tester 108, the lab data 110, or a combination thereof, to the computer-readable medium 106 for storage, for example. In another example, the input device 104 may be a device used for requesting access to the strength test data 120, requesting different formats of the strength test data, or a combination thereof.

FIG. 2 is an example of a system 200 for determining penetration gradients of a formation material of multiple fracking stages (e.g., fracking stage 210*a* to fracking stage 210*n*), in accordance with certain embodiments. The fracking stage 210*a* to the fracking stage 210*n* may herein be collectively referred to as multiple fracking stages 210. The system 200 is the system 100 of FIG. 1, for example. The system 200 includes a computer system 216 communicatively coupled to a perforation device 204 via a wireline 202. The computer system 216 includes a strength tester 218. The strength tester 218 is the strength tester 108 of FIG. 1, for example. The perforation device 204 is the perforation device 112, for example. The perforation device 204 includes a logging device 206 and a shaped charge device 208. The shaped charge device 208 is the shaped charge device 114, for example. The logging device 206 is the logging device 116, for example.

In some applications, the multiple fracking stages 210 can form part of an oil or gas infrastructure. For example, the multiple fracking stages 210 can correspond to different sections within an upstream sector. The upstream sector (also known as exploration and production) covers exploration, recovery, and production of crude oil and natural gas. Examples are presented herein in which the strength tester 218 is used for improving a determination of a number of perforation tunnels within each of the multiple fracking stages 210 to facilitate recovery and production in the upstream sector. However, in other examples, the strength tester 218 can be used in other industries.

In some examples, the strength tester 218 can output strength test data 220 characterizing the respective strength for each fracking stage of the multiple fracking stages 210. The strength test data 220 can then be rendered on a display device (e.g., the display device 122 described with respect to FIG. 1), and thus enable a user (e.g., a technician) to visualize a result of the strength tester 218. In some examples, the strength test data 220 can be stored in a computer-readable medium (e.g., the computer-readable medium 106 described with respect to FIG. 1). In some examples, the strength tester 218 can receive an input to enable the strength tester 218 to determine one or more penetration gradients for each of the multiple fracking stages 210.

In a non-limiting example, the shaped charge device 208 creates a cluster of multiple perforation tunnels 212 in a formation material of a fracking stage 210*a*. The shaped charge device 208 may create the cluster using techniques described with respect to FIG. 1, for example. The logging device 206 detects a depth of each perforation tunnel of the multiple perforation tunnels 212. For example, the logging device 206 detects a depth 213*a* of a first perforation tunnel, a depth 213*b* of a second perforation tunnel, . . . a depth 213*n* of an nth perforation tunnel. The depth 213*a*, the depth 213*b*, . . . the depth 213*n* may herein collectively be referred to as the depths 213. The logging device 206 detects the depths 213 using techniques described with respect to FIG. 1, for example. The logging device 206 transmits the depths 213 to the computer system 216 wirelessly or via the wireline 202. The strength tester 218 determines a penetration gradient of the fracking stage 210*a* based on the depths 213. The strength tester 218 determines the penetration gradient using the techniques described with respect to FIG. 1, for example. The strength tester 218 classifies the fracking stage 210*a* based on the penetration gradient using the techniques described with respect to FIG. 1, for example.

In a non-limiting example, the strength tester 218 outputs a plot of the penetration gradient associated with the fracking stage 210*a* versus lab data 214 associated with the fracking stage 210*a*. The lab data 214 may be the lab data 110 of FIG. 1, for example. Based on a comparison of the penetration gradient of the fracking stage 210*a* and the lab data 214, the strength tester 218 determines a classification for the fracking stage 210*a* using the techniques described with respect to FIG. 1, for example. Based on the classification, the shaped charge device 208 may create one or more additional clusters of perforation tunnels 212 in the fracking stage 210*a*.

In a non-limiting example, the process is repeated for each fracking stage of the multiple fracking stages 210. In some example, a number of clusters of perforation tunnels 212 in a first fracking stage of the multiple fracking stages 210 is different than a number of clusters of perforation tunnels 212 in a second fracking stage of the multiple fracking stages 210.

Figure 3:
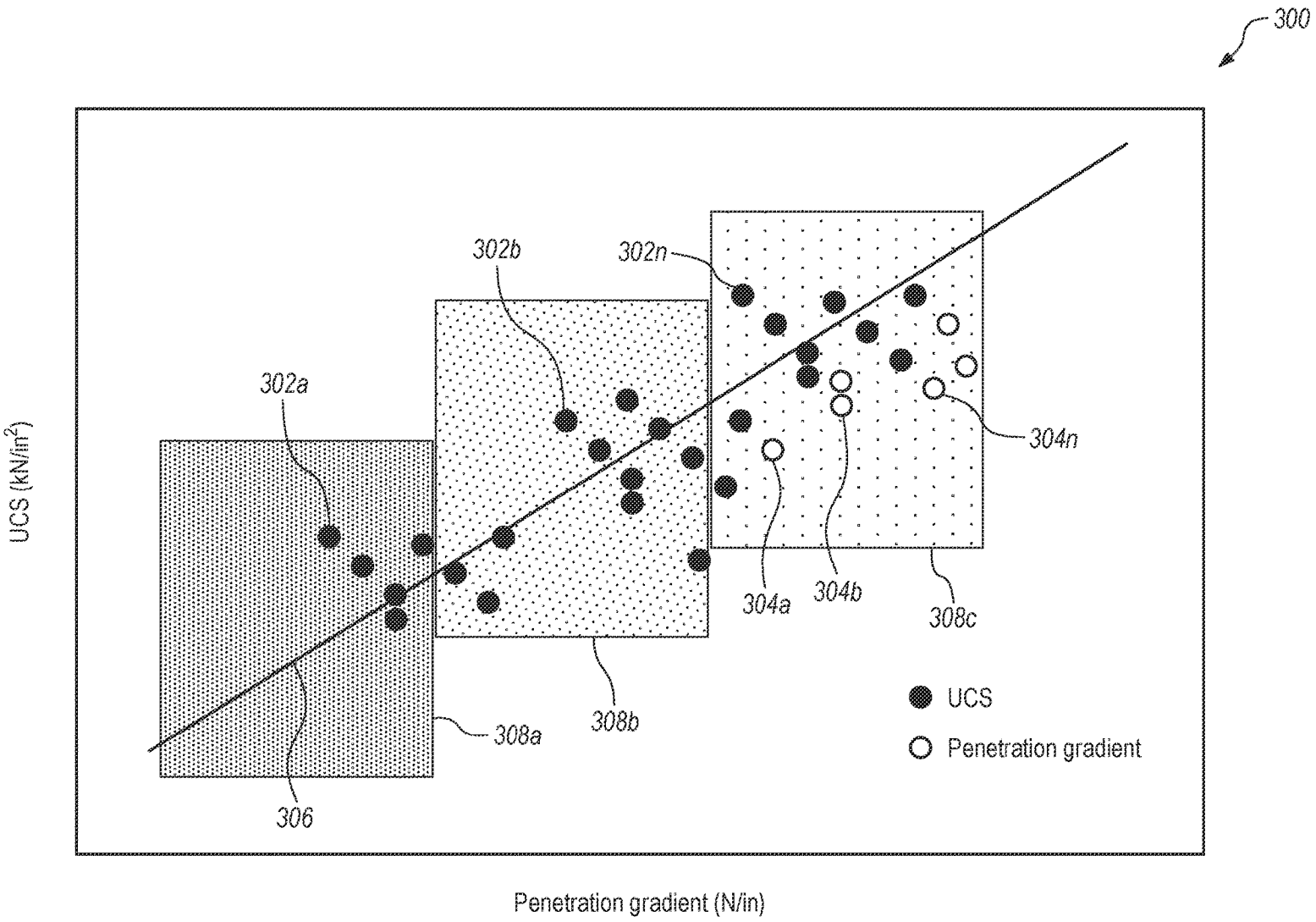
FIG. 3 is an example of a plot of penetration gradients of multiple fracking stages, in accordance with certain embodiments.

FIG. 3 is an example of a plot 300 of penetration gradients, as indicated by the outlined circles, of multiple fracking stages, in accordance with certain embodiments. The plot 300 includes penetration gradients 304*a*, 304*b*, . . . 304*n*, as indicated by the outlined circles and which are herein referred to collectively as the penetration gradients 304. A strength tester (e.g., the strength tester 108 of FIG. 1, the strength tester 218 of FIG. 2) determines the penetration gradients 304 using techniques described with respect to FIG. 1 or 2, for example. The plot 300 also includes lab data 302*a*, 302*b*, . . . 302*n*, as indicated by the solid circles and which are herein referred to collectively as lab data 302. The lab data 302 may be the lab data 110 described in FIG. 1 or the lab data 214 described in FIG. 2, for example. The lab data 302 includes UCS data, for example. In a non-limiting example, areas 308*a*, 308*b*, 308*c* each include geological, mechanical and petrophysical lab data 302 for different rock types. For example, area 308*a* includes lab data 302*a* for a first type of rock, area 308*b* includes lab data 302*b* for a second type of rock, and area 308*c* includes lab data 302*n* for an nth type of rock. In a non-limiting example, the lab data 302 is measured in UCS units (e.g., $kN/in^2$). The plot 300 also includes line 306, which represents a linear relationship of the lab data 302 versus the penetration gradients 304. A slope of the line 306 is an average value of the lab data 302, for example. In a non-limiting example, the line 306 is determined by the strength tester using techniques described with respect to FIG. 1 or 2, for example. The strength tester may use the line 306 to determine a risk profile of different fracking stages and generate classifications of the different fracking stages using techniques as described herein with respect to FIG. 1 or 2, for example.

Figure 4:
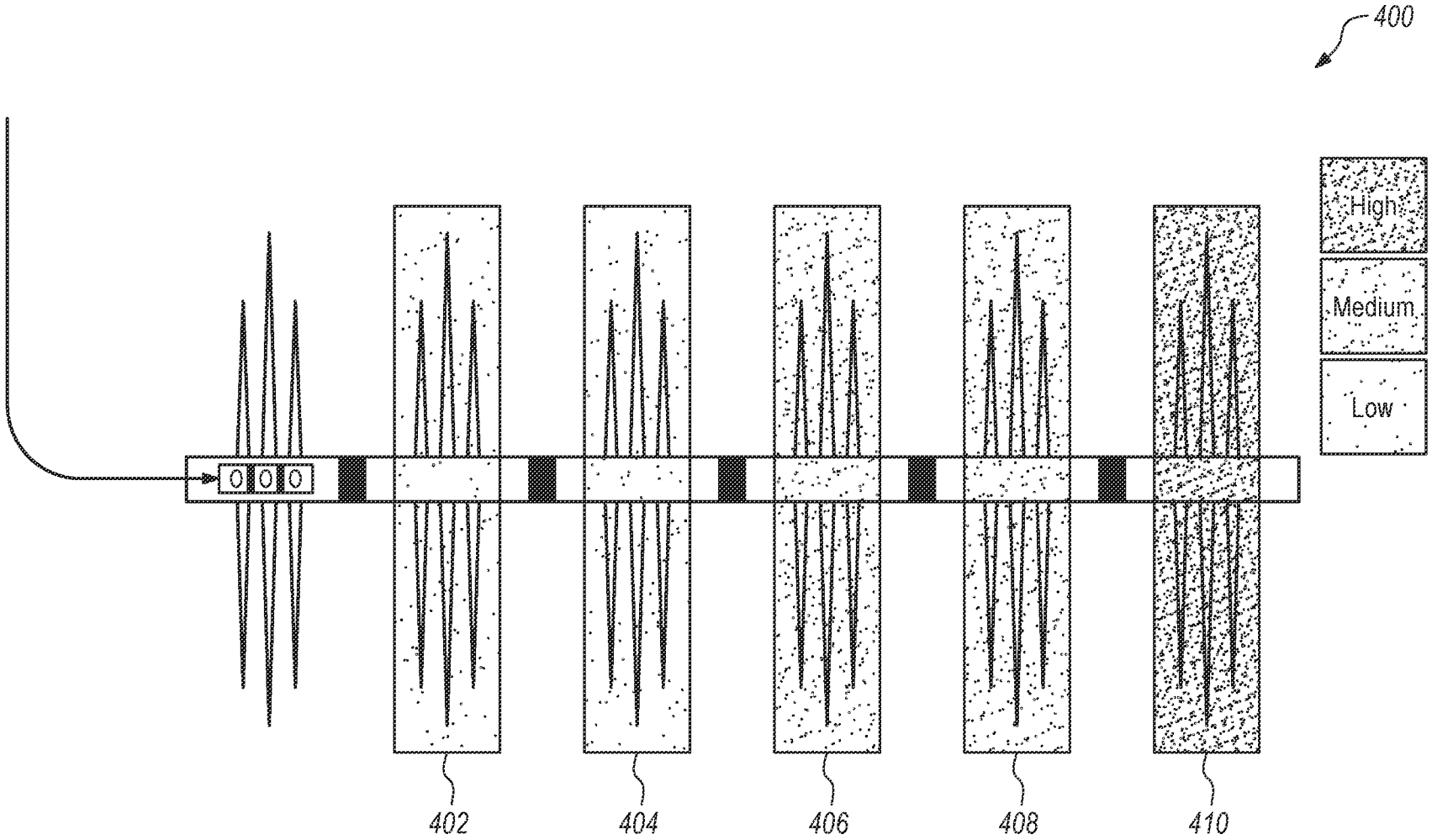
FIG. 4 is an example of a classification of multiple fracking stages based on risk profiles, in accordance with certain embodiments.

FIG. 4 is an example of a classification map 400 of multiple fracking stages 402, 404, 406, 408, 410 based on risk profiles, in accordance with certain embodiments. The classification map 400 is a visual of the multiple fracking stages 402, 404, 406, 408, 410 including gradients that indicate a classification for each of the multiple fracking stages 402, 404, 406, 408, 410. For example, a fracking stage 402 and a fracking stage 404 have a first gradient, a fracking stage 406 and a fracking stage 408 have a second gradient, and a fracking stage 410 has a third gradient. In a non-limiting example, the first gradient may indicate a low risk for the fracking stages 402, 404, the second gradient may indicate a medium risk for the fracking stages 406, 408, and a high risk for the fracking stage 410. In a non-limiting example, a strength tester (e.g., the strength tester 108 of FIG. 1, the strength tester 218 of FIG. 2) determines the risk using techniques described with respect to FIG. 1 or 2, for example.

Figure 5:
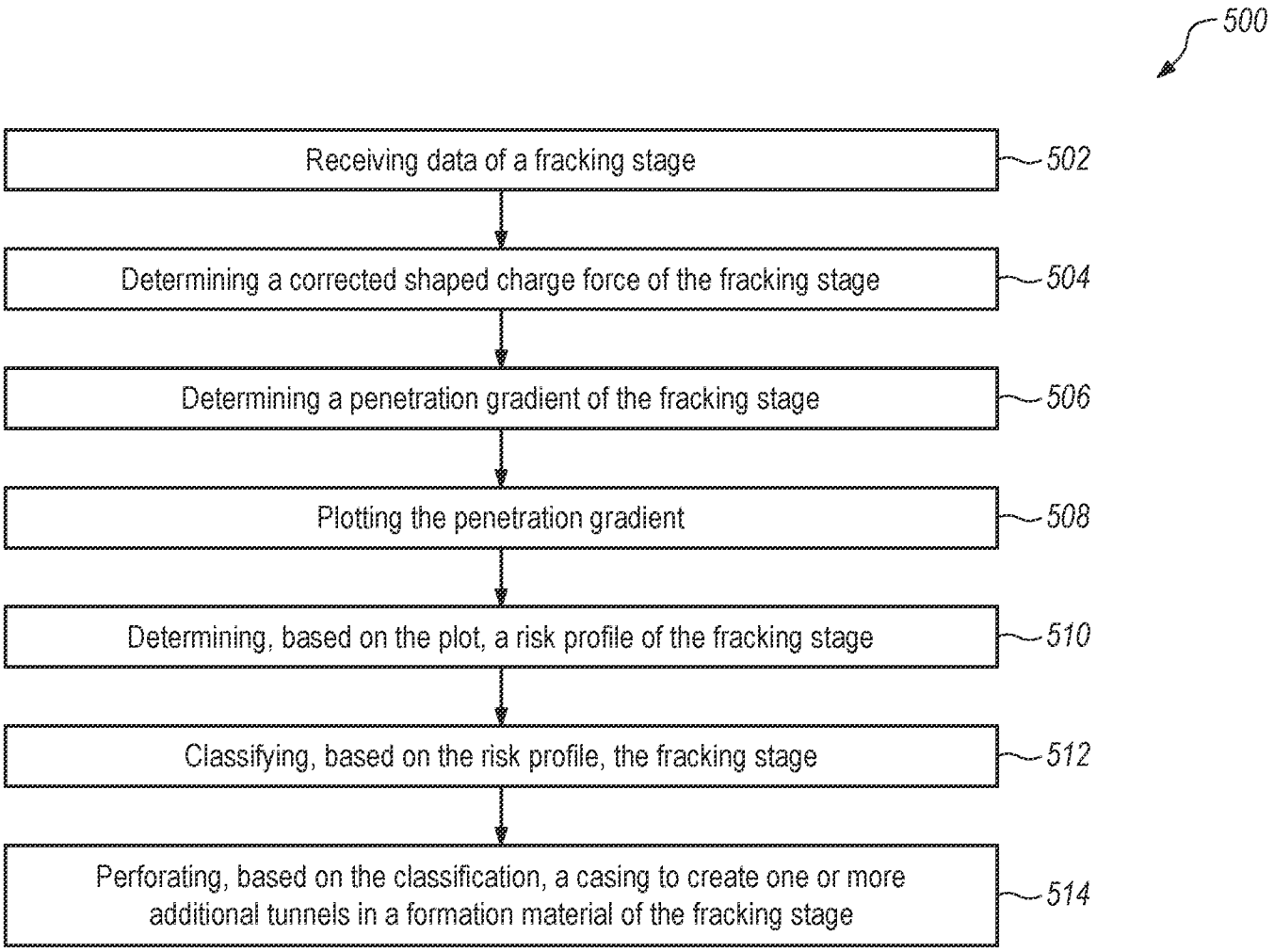
FIG. 5 is an example of a method for determining a penetration gradient of a formation material of a fracking stage, in accordance with certain embodiments.

In view of the foregoing structural and functional features described herein, an example method will be better appreciated with reference to FIG. 5. While, for purposes of simplicity of explanation, the example method of FIG. 5 is shown and described as executing serially, it is to be understood and appreciated that the present examples are not limited by the illustrated order, as some actions could in other examples occur in different orders, multiple times and/or concurrently from that shown and described herein. Moreover, it is not necessary that all described actions be performed to implement the method.

FIG. 5 is an example of a method 500 for determining a penetration gradient of a formation material of a fracking stage, in accordance with certain embodiments. The method 500 can be at least partially implemented by a strength tester, such as the strength tester 108, as shown in FIG. 1, or the strength tester 218, as shown in FIG. 2. Thus, reference can be made to the example of FIGS. 1-4 in the example of FIG. 5. The method 500 includes one or more of the steps of receiving data of a fracking stage (502), determining a corrected shaped charge force of the fracking stage (504), determining a penetration gradient of the fracking stage (506), plotting the penetration gradient (508), determining a risk profile of the fracking stage (510), classifying the fracking stage (512), and perforating a casing to create one or more additional tunnels in a formation of the fracking stage.

In a non-limiting example, the method 500 can begin at 502 by receiving data (e.g., data of sensor 118, as described with respect to FIG. 1, or data of logging device 206, as described with respect to FIG. 2) of the fracking stage (e.g., fracking stage 210, as shown in FIG. 2). For example, at 502, the strength tester 108, as shown in FIG. 1, or the strength tester 218, as shown in FIG. 2, can cause a display device (e.g., the display device 122, as shown in FIG. 1) to display information indicating a start of the strength test. In another non-limiting example, the strength tester can cause the display device to display the data. For example, the strength tester can parse the data, assign labels to the parsed data, and cause the display device to display the labeled and parsed data. The strength tester can cause the display device to display the corrected shaped charge force of the fracking stage, in a non-limiting example. At 508, the strength tester may cause the display device to display the plot of the penetration gradient. For example, the strength tester may cause the display device to display a plot 300 of the penetration gradient versus lab data, as described with respect to FIG. 3. At 512, the strength tester may cause the display device to display a classification map of the fracking stage. The strength tester may cause the display device to display the classification map 400, as described with respect to FIG. 4, for example. In a non-limiting example, the method 500 includes the strength tester determining whether to increase or decrease a number of clusters of a perforation plan based on the classification, using techniques as described herein with respect to FIG. 1 or 2. At 514, the method 500 includes perforating a casing of the fracking stage to create one or more additional clusters in the formation material of the fracking stage. In a non-limiting example, the method 500 is repeated for one or more additional fracking stages.

In view of the foregoing structural and functional description, those skilled in the art will appreciate that portions of the embodiments described herein may be implemented as a method, data processing system, or computer program product (e.g., computer application). Accordingly, these portions of the present disclosure may take the form of an entirely hardware embodiment, an entirely software embodiment, or an embodiment combining software and hardware, such as shown and described with respect to the computer system of FIG. 6. Furthermore, portions of the embodiments herein may be a computer program product on a computer-readable medium having computer-readable program code on the medium. Any suitable non-transitory computer-readable medium may be utilized including, but not limited to, static and dynamic storage devices, hard disks, optical storage devices, and magnetic storage devices, but excludes any medium that is not eligible for patent protection under 35 U.S.C. § 101 (such as a propagating electrical or electromagnetic signals per se). As an example and not by way of limitation, computer-readable storage media may include a semiconductor-based circuit or device or other integrated circuit (IC) (such, as for example, a field-programmable gate array (FPGA) or an ASIC), a hard disk, an HDD, a hybrid hard drive (HHD), an optical disc, an optical disc drive (ODD), a magneto-optical disc, a magneto-optical drive, a floppy disk, a floppy disk drive (FDD), magnetic tape, a holographic storage medium, a solid-state drive (SSD), a RAM-drive, a SECURE DIGITAL card, a SECURE DIGITAL drive, or another suitable computer-readable storage medium or a combination of two or more of these, where appropriate. A computer-readable non-transitory storage medium may be volatile, nonvolatile, or a combination of volatile and non-volatile, as appropriate.

Certain embodiments described herein have also been described herein with reference to block illustrations of methods, systems, and computer program products. It will be understood that blocks of the illustrations, and combinations of blocks in the illustrations, can be implemented by computer-executable instructions. These computer-executable instructions may be provided to one or more processor of a general purpose computer, special purpose computer, or other programmable data processing apparatus (or a combination of devices and circuits) to produce a machine, such that the instructions, which execute via the processor, implement the functions specified in the block or blocks. These computer-executable instructions may also be stored in a computer-readable medium that can direct a computer or other programmable data processing apparatus to function in a particular manner, such that the instructions stored in the computer-readable medium result in an article of manufacture including instructions which implement the function specified in the flowchart block or blocks. The computer-executable instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions specified in the flowchart block or blocks.

FIG. 6 is a block diagram of a computer system 600 that can be employed to execute a system for determining penetration gradients in accordance with certain embodiments described. The computer system 600 may be the computer system 216 of FIG. 2, for example. Computer system 600 can be implemented on one or more general purpose networked computer systems, embedded computer systems, routers, switches, server devices, client devices, various intermediate devices/nodes or standalone computer systems. Additionally, computer system 600 can be implemented on various mobile clients such as, for example, a personal digital assistant (PDA), laptop computer, pager, and the like, provided it includes sufficient processing capabilities.

Computer system 600 includes processing unit 602, system memory 604, and system bus 606 that couples various system components, including the system memory 604, to processing unit 602. Dual microprocessors and other multiprocessor architectures also can be used as processing unit 602. System bus 606 may be any of several types of bus structure including a memory bus or memory controller, a peripheral bus, and a local bus using any of a variety of bus architectures. System memory 604 includes read only memory (ROM) 610 and random access memory (RAM) 612. A basic input/output system (BIOS) 614 can reside in ROM 610 containing the basic routines that help to transfer information among elements within computer system 600.

Computer system 600 can include a hard disk drive 616, magnetic disk drive 618, e.g., to read from or write to removable disk 620, and an optical disk drive 622, e.g., for reading CD-ROM disk 624 or to read from or write to other optical media. Hard disk drive 616, magnetic disk drive 618, and optical disk drive 622 are connected to system bus 606 by a hard disk drive interface 626, a magnetic disk drive interface 628, and an optical drive interface 630, respectively. The drives and associated computer-readable media provide nonvolatile storage of data, data structures, and computer-executable instructions for computer system 600. Although the description of computer-readable media above refers to a hard disk, a removable magnetic disk and a CD, other types of media that are readable by a computer, such as magnetic cassettes, flash memory cards, digital video disks and the like, in a variety of forms, may also be used in the operating environment; further, any such media may contain computer-executable instructions for implementing one or more parts of embodiments shown and described herein.

A number of program modules may be stored in drives and RAM 612, including operating system 632, one or more computer application programs 634, other program modules 636, and program data 638. In some examples, the computer application programs 634 can include one or more sets of computer-executable instructions of the strength tester 108 of FIG. 1 or the strength tester 218 of FIG. 2 and the program data 638 can include the lab data 110 stored to the computer-readable medium 106 of FIG. 1 or the lab data 214 of FIG. 2. The computer application programs 634 and program data 638 can include functions and methods programmed to perform the method 500 to provide a strength tester for determining penetration gradients, such as shown and described herein.

A user may enter commands and information into computer system 600 through one or more input devices 640, such as a pointing device (e.g., a mouse, touch screen), keyboard, microphone, joystick, game pad, scanner, and the like. The input device 640 may be the input device 104, for example. The user can employ input device 640 to edit or modify the strength tester 108 of FIG. 1 or the strength tester 218 of FIG. 2, the lab data 110 stored to the computer-readable medium 106 of FIG. 1, or the lab data 214 of FIG. 2, for example. These and other input devices 640 are often connected to processing unit 602 through a corresponding port interface 642 that is coupled to the system bus, but may be connected by other interfaces, such as a parallel port, serial port, or universal serial bus (USB). One or more output devices 644 (e.g., display, a monitor, printer, projector, or other type of displaying device) is also connected to system bus 606 via interface 646, such as a video adapter. An output device 644 may be the display device 122 in a non-limiting example.

Computer system 600 may operate in a networked environment using logical connections to one or more remote computers, such as remote computer 648. Remote computer 648 may be a workstation, computer system, router, peer device, or other common network node, and typically includes many or all the elements described relative to computer system 600. The logical connections, schematically indicated at 650, can include a local area network (LAN) and a wide area network (WAN). When used in a LAN networking environment, computer system 600 can be connected to the local network through a network interface or adapter 652. When used in a WAN networking environment, computer system 600 can include a modem, or can be connected to a communications server on the LAN. The modem, which may be internal or external, can be connected to system bus 606 via an appropriate port interface. In a networked environment, computer application programs 634 or program data 638 depicted relative to computer system 600, or portions thereof, may be stored in a remote memory storage device 654.

The terminology used herein is for the purpose of describing particular embodiments only and is not intended to limit this disclosure. As used herein, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof. Also, the phraseology and terminology used herein is for the purpose of description and should not be regarded as limiting. The use of "including," "comprising," "having," "containing," "involving," and variations thereof herein, is meant to encompass items listed thereafter and equivalents thereof as well as additional items. While the disclosure has described several exemplary embodiments, it will be understood by those skilled in the art that various changes can be made, and equivalents can be substituted for elements thereof, without departing from the spirit and scope of the invention.

In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

The invention claimed is:

1. A system comprising:

a computer-readable medium storing computer-executable instructions; and one or more processors communicatively coupled to a computer-readable medium storing computer-executable instructions, which, when executed by the one or more processors cause the one or processors to:

receive data of a fracking stage;

determine a penetration gradient of the fracking stage based on the data;

plot the penetration gradient of the fracking stage versus one or more uniaxial compressive strengths;

determine, using the plot, a risk profile of the fracking stage; and classify the fracking stage based on the risk profiles and the penetration gradient.

2. The system of claim 1, wherein the processor is operable to:

cause a shaped charge device of a perforation device to perforate a casing of the fracking stage to create a cluster of one or more perforation tunnels within a formation material; and wherein the data of the fracking stage includes a depth of one or more perforation tunnels.

3. The system of claim 2, wherein the processor is operable to:

cause one or more sensors of a logging device of the perforation device to transmit the data from the sensors.

4. The system of claim 3, wherein the logging device includes at least one of a fiber optic sensor, a sonic sensor, a high-resolution acoustic imaging sensor, an electromagnetic sensor, a Radio Detection and Ranging (RADAR) sensor, or a Light Detection and Ranging (LiDAR) sensor.

5. The system of claim 2, wherein the processor is operable to:

determine a corrected shaped charge force of the cluster of one or more perforation tunnels; and determine the penetration gradient of the cluster based on the corrected shaped charge force and the depth of each perforation tunnel of the one or more perforation tunnels.

6. The system of claim 5, wherein the cluster includes multiple perforation tunnels, and wherein the processor is to:

determine a penetration gradient of each perforation tunnel of the multiple perforation tunnels by dividing the corrected shaped charge force by a depth for each perforation tunnel; and sum the penetration gradients of each perforation tunnel of the multiple perforation tunnels to determine the penetration gradient of the cluster.

7. The system of claim 6, wherein the cluster is a first cluster of multiple clusters of the fracking stage, and wherein the processor is to determine the penetration gradient of the fracking stage by summing the penetration gradient of each cluster of the multiple clusters.

8. The system of claim 1, wherein the processor is operable to:

cause a shaped charge device to create one or more additional perforation tunnels in the fracking stage based on the classification of the fracking stage.

9. A method for determining a penetration gradient of a formation material, the method comprising:

receiving data of a fracking stage;

determining a penetration gradient of the fracking stage based on the data;

plotting the penetration gradient versus uniaxial compressive strength (UCS) data;

determining, using the plot, a risk profile of the fracking stage; and classifying the fracking stage based on the risk profile and the penetration gradient.

10. The method of claim 9, wherein the data of the fracking stage includes a depth of one or more perforation tunnels created using a shaped charge device of a perforation device.

11. The method of claim 10, further comprising:

determining a corrected shaped charge force of a cluster of the one or more perforation tunnels.

12. The method of claim 11, further comprising:

determining a penetration gradient for each tunnel of the one or more perforation tunnels of the cluster by dividing the corrected shaped charge force of the cluster by a depth of each tunnel, respectively; and summing the penetration gradients for each tunnel to determine the penetration gradient of the cluster, wherein the penetration gradient of the fracking stage is equivalent to the penetration gradient of the cluster.

13. The method of claim 9, further comprising perforating, using a shaped charge device of a perforation device, a casing to create one or more additional tunnels in the formation of the fracking stage based on the classification.

14. A system comprising:

a computer-readable medium storing computer-executable instructions;

one or more processors communicatively coupled to a computer-readable medium storing computer-executable instructions, which, when executed by the one or more processors cause the one or processors to:

receive data of a fracking stage, the data of the fracking stage having a depth of multiple perforation tunnels;

create a cluster of the multiple perforation tunnels within a formation material;

determine a corrected shaped charge force of the cluster of the multiple perforation tunnels;

determine a penetration gradient of each perforation tunnel of the multiple perforation tunnels by dividing the corrected shaped charge force by a depth for each perforation tunnel;

sum the penetration gradients of each perforation tunnel of the multiple perforation tunnels to determine the penetration gradient of the cluster; and classify the fracking stage based on the penetration gradient.

15. The system of claim 14, wherein the processor is operable to cause a shaped charge device of a perforation device to perforate a casing of the fracking stage.

* * * * *